US008327767B2

(12) United States Patent
Lafortune

(10) Patent No.: US 8,327,767 B2
(45) Date of Patent: Dec. 11, 2012

(54) REDUCED ENERGY TRAINING CARTRIDGE FOR STRAIGHT BLOW BACK OPERATED FIREARMS

(75) Inventor: Eric Lafortune, Terrebonne (CA)

(73) Assignee: General Dynamics-Ordnance and Tactical Systems Canada, Inc.

( * ) Notice: Subject to any disclaimer, the term of this patent is extended or adjusted under 35 U.S.C. 154(b) by 0 days.

(21) Appl. No.: 13/015,241

(22) Filed: Jan. 27, 2011

(65) Prior Publication Data

US 2012/0192751 A1 Aug. 2, 2012

(51) Int. Cl.
*F42B 30/00* (2006.01)

(52) U.S. Cl. ..... 102/439; 102/444; 102/446

(58) Field of Classification Search ..... 102/430, 102/439, 444, 446, 447, 464, 520, 521, 522
See application file for complete search history.

(56) References Cited

U.S. PATENT DOCUMENTS

| | | | | |
|---|---|---|---|---|
| 5,016,536 | A * | 5/1991 | Brighton | 102/430 |
| 5,492,063 | A | 2/1996 | Dittrich | |
| 5,677,505 | A | 10/1997 | Dittrich | |
| 6,095,051 | A | 8/2000 | Saxby | |
| 6,439,123 | B1 * | 8/2002 | Dionne et al. | 102/430 |
| 6,575,098 | B2 | 6/2003 | Hsiung | |
| 6,626,113 | B1 | 9/2003 | Gilman et al. | |
| 6,845,716 | B2 | 1/2005 | Husseini et al. | |
| 7,225,741 | B2 | 6/2007 | Huffman | |
| 7,984,668 | B2 | 7/2011 | Huffman | |

FOREIGN PATENT DOCUMENTS

| | | |
|---|---|---|
| EP | 0737298 | 10/1996 |

* cited by examiner

*Primary Examiner* — Gabriel Klein
(74) *Attorney, Agent, or Firm* — Harvey S. Kauget; Phelps Dunbar LLP

(57) ABSTRACT

The present invention discloses a reduced energy training cartridge for use in a straight blowback operated firearm having a barrel with firing chamber, the cartridge comprising a cartridge case being defined by a rear portion with an external groove, a front portion having a velocity reduction structure and a wall with an outer surface and an inner surface, a sabot slideably engaged within the cartridge case, the sabot having a rear portion with an outside diameter substantially equal to the inside diameter of the inner surface of the cartridge case and which contains a gas sealing and braking structure and a primer disposed in the rear portion of the cartridge case where, upon percussion of the primer, the cartridge case rapidly slides relative to the sabot until such point when the velocity reduction structure of the cartridge case engages with the sealing and braking structure of the sabot, thereby stopping further movement of the cartridge case relative to the sabot, The present invention also contemplates using a metallic case in combination with a non-metallic or polymer sabot.

24 Claims, 4 Drawing Sheets

10 CARTRIDGE ASSEMBLY

(15) FIRED CARTRIDGE

10 CARTRIDGE ASSEMBLY

(15) FIRED CARTRIDGE

REDUCED ENERGY TRAINING CARTRIDGE FOR STRAIGHT BLOW BACK OPERATED FIREARMS

FIELD OF THE INVENTION

The present invention generally relates to ammunition and, more particularly to reduced energy ammunition used with straight blowback operated firearms in training exercises.

BACKGROUND OF THE INVENTION

Members of the military, law enforcement and other such entities greatly benefit from experiencing training exercises which are as close to real-life combat as possible in order to better hone both their marksmanship and tactical strategy. Thus, many such institutions utilize reduced energy, training products which permit the simulation of a "live fire" event without the risks associated with using conventional live ammunition. Such products can include converted or dedicated automatic or semi-automatic straight blowback operated firearms used to fire the reduced energy ammunition. Being able to employ an individual's own service-issued firearm in such training exercises brings added realism to each scenario. The projectiles fired from such modified firearms tend to include some sort of marking substance, i.e., paint or dye, a blank or a short range target projectile. In addressing the needs of the users of such systems, various inventors have provided solutions allowing the conversion of service-issued firearms to fire reduced energy training cartridges with varying success.

In general, the reduced energy ammunition of the prior art employs a two-piece casing within which the projectile is seated. The first portion of the cartridge is a case which typically resembles the rearward portion of a conventional round of ammunition. The second portion is a sabot which is typically inserted into the first portion and serves to channel a controlled amount of gas pressure from the cartridge explosive charge toward the projectile. The total cartridge explosive charge is the sum of charge contained in the primer and the propellant powder, if such powder is used. Depending on the type of primer selected, it is possible to operate reduced energy ammunition on the primer charge alone.

Examples of such cartridges are shown in U.S. Pat. No. 6,575,098 to Hsiung and U.S. Pat. No. 5,395,937 to Dittrich. While the ammunition disclosed in these and other references are adequate for the desired purpose, there are several shortcomings present in the prior art which the present invention seeks to address.

First, the design of reduced energy ammunition casings in the prior art are often made of conventional cartridge brass. Cartridge brass is typically employed in the manufacturing of thin walled casings with folded mouth designs because of its malleability and relative strength-to-thickness ratio gained through cold working. However, cartridge brass is relatively expensive for reduced energy cartridge case application when compared with alternative materials such as aluminum alloys, zinc alloys, other alloys, steel or even polymers. The use of such alternative materials tends to reduce the raw material and manufacturing costs, but generally requires the ammunition casing itself to be thicker due to the decrease in physical strength associated with these materials as well as to facilitate associated high volume manufacturing processes.

It is noted that the of use polymer casings is hinted at in the prior art, however polymers are not generally a good choice for the casing material for several reasons. First, their lack of compressive strength results in an inability to retain a pressfitted primer. Also, the relatively low tensile strength of polymer casings makes it difficult for them to resist and contain gas pressure of the application. Additionally, the use of polymers in the sabot cartridge component involves significant design challenges with regard to the impact, compressive, tensile and shearing strength, etc., of such materials when exposed to the stresses present when the ammunition is assembled, stored or fired over the ammunition's standard application temperature range which can vary by as much as 72° C. Such design implications and solutions for the same are not discussed in the prior art. Thus, when using alternative materials in a reduced energy training cartridge there exists a need for a design which permits safe, consistent operation of the ammunition while simultaneously being able to utilize comparatively inexpensive materials.

Second, many existing designs for reduced energy training ammunition contain complex designs which add to manufacturing delays and increased production complexity. For example, U.S. Pat. No. 6,575,098 to Hsiung requires the forward portion of the casing to have an internal groove and have a spring-like component inserted during manufacture. Additionally, other known designs employ rubber gaskets in order to provide an acceptable gas seal between the two metallic casing components. Thus, there exists a need for a reduced energy training round which employs inexpensive materials while simultaneously providing a simple and robust design which can easily be manufactured on a large scale.

BRIEF SUMMARY OF THE INVENTION

The present invention discloses a reduced energy training cartridges for use in straight blowback operated firearms. The subject design can be applied to a variety of calibers, including 9 mm, 5.56 mm, etc., as well as various external ballistics or blank cartridge applications relating to the same. The cartridge comprising a cartridge case being defined by a rear portion with an external groove, a front portion having a velocity reduction structure and a wall with an outer surface and an inner surface, a sabot slideably engaged within the cartridge case, the sabot having a rear portion with an outside diameter substantially equal to the inside diameter of the inner surface of the cartridge case and which contains a gas sealing and braking structure and a primer disposed in the rear portion of said cartridge case where, upon percussion of the primer, cartridge gas pressure expansion causes the cartridge case to slide rapidly relative to the sabot until such point when the velocity reduction structure of the cartridge case engages with the braking structure of the sabot, thereby stopping further movement of the cartridge case relative to the sabot.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

DETAILED DESCRIPTION OF THE INVENTION

Figure 1:
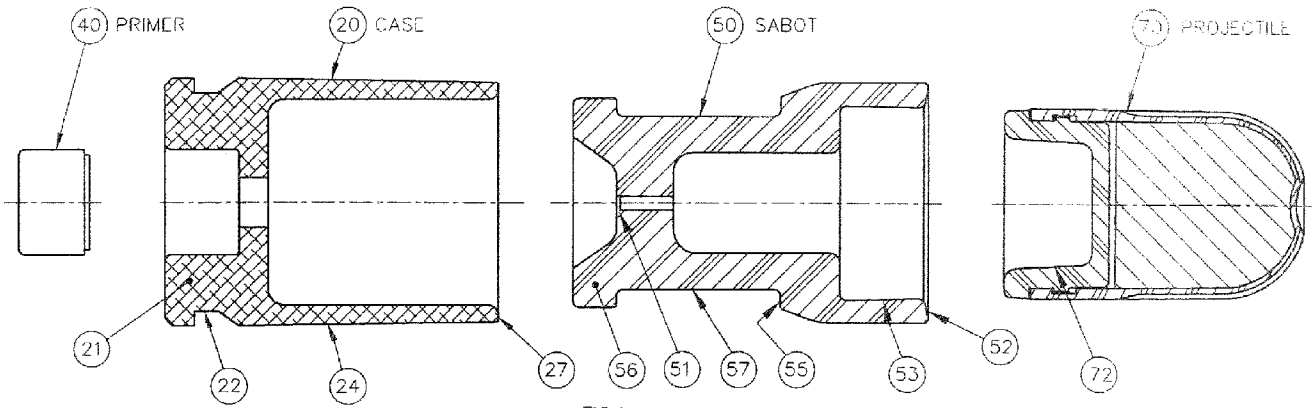
FIG. 1 is an exploded side view of one embodiment of the present invention.

Referring now to the drawings, the improved reduced energy training cartridge of the present invention is described. The cartridge 10 comprises a case 20 containing a primer 40 located at the rear portion 21 of the case 20. Case 20 is preferably made from a material other than brass and most preferably is made from aluminum alloy, zinc alloy or steel. In a preferred embodiment, rear portion 21 contains at least one gas passage port 26. Upon insertion of sabot 50 into case 20, a combustion chamber 60 is formed. Gas passage port 26 serves to enable gas pressure emitted from primer 40 upon firing to pass from primer 40 into combustion chamber 60. Primer 40 is of types well known to those skilled in the art. Depending on the configuration, primer 40 can be used to ignite a charge of propellant 42 located within combustion chamber 60, or the present invention can be operated solely on the explosive energy contained within primer 40. The rear portion of case 20 has a groove 22 located about the circumference of case 20 to aid in the extraction and ejection of fired cartridge 15 from the firearm. The design of groove 22 is similar to the design present on a conventional, "live" ammunition round of same caliber to that of cartridge 10.

Case 20 further contains an outer wall 24, a portion of which is formed into a velocity reduction structure 30 at the front portion 27 of the case 20. Velocity reduction structure 30 is defined by a canted surface 32 and a cylindrical surface 34. In a preferred embodiment, canted surface 32 originates from outer wall 24 with a slightly curved approach, however a clearly defined angle marking the transition from outer wall 24 to canted surface 32 is also functionally acceptable. Cylindrical surface 34 is preferably a straight cylinder, i.e., is parallel to the centerline of case 20, however with appropriate tooling, cylindrical surface 34 could be made tapered up to +/−10° or more and still remain effective. The external surface of velocity reduction structure 30 may have slight pinch marks generated by the assembly forming tool.

Canted surface 32 ends at a distance $X_1$ from the front portion 27 of case 20. The degree of slant present in canted surface 32 relative to the centerline of case 20 is expressed by canting angle $\phi$ Canting angle $\phi$ must be carefully selected based on the material chosen for sabot 50 and case 20 relative to cartridge gas pressure level, case 20 sliding distance $X_6$, sabot sealing and breaking structure 56 and case 20 thickness, etc. It is desired in the present invention to provide a cartridge 10 employing a case 20 made from competitively priced metal alloy or metal in combination with a sabot 50 made from a competitively priced engineering polymer having a good combination of performance and price.

The significant limitations in overall physical strength when using polymers in combination with the alternative casing materials as discussed in the present invention requires a completely new cartridge design as those designs present in the prior art are not feasible or economical with such materials and involved high volume manufacturing processes. The use of polymers results in a significant reduction in the overall impact, compressive, tensile and shear strength of sabot 50 when compared with using a sabot 50 made from a metallic material as is known in the art. In other words, when using such polymers for sabot 50, a canting angle $\phi$ which is too great will result in an unacceptable rate of sheared sabot sealing and braking structure 56 upon firing of the cartridge 10 because of the abrupt impact loading action combined with physical limitations of the material over standard application temperature range. Conversely, selecting a canting angle $\phi$ too small will result in unacceptable rate of sabot 50 expulsion from case 20 because of insufficient structural retaining strength of the velocity reduction structure 30. The canting angle $\phi$ and length $X_1$ are preferably controlled through the closing diameter ø of the cylindrical surface 34, the structural retaining strength of velocity reduction structure 30 is preferably controlled through the length $X_2$ of the cylindrical surface 34, as $X_2$ increases the strength increases.

Additionally, in a preferred embodiment, the interaction between velocity reduction structure 30 which is metallic and the non-metallic sabot sealing and braking structure 56 provides excellent gas pressure sealing performance. Such sealing translates into high performance cartridge operation with constant projectile velocities and constant firearm recoil force over the applications temperature range.

As an example for cartridge assembly 10, when using a sabot 50 made from engineering polymer with a case 20 made from appropriate grade of metallic materials such as aluminum alloy, zinc alloy or steel a canting angle $\phi$ of between 5° and 45° is acceptable with a range of between 10° and 25° being more preferred and 17° being most preferred. It is important to note that when using a sabot 50 made from engineering polymer in combination with a case 20 made from appropriate alternative metallic materials such as aluminum alloy, zinc alloy or steel, the sabot retention methods presently known in the art, i.e., thin brass cases with a folded mouth, metallic components with rubber seals, etc. are not technically or economically viable. Consequently, the geometry of the velocity reduction structure 30 disclosed herein plays a critical role in providing a simple and robust design which can easily be manufactured from competitively priced materials on a large scale ensuring consistent operational performance of cartridge 10. Thus, the present invention provides a new approach to producing a simple, cost effective, robust and reliable operational reduced energy training cartridge 10 with a metallic case 20 and a non-metallic sabot 50 made from a competitively priced materials and processes using the velocity reduction structure 30. Additionally, the combination of a case 20 made from an alternative metallic material such as aluminum alloy coupled with a non-metallic sabot 50 translates into a significant overall weight reduction of cartridge 10 (i.e., up to 50%) when compared to a case 20 made with traditional cartridge brass or steel. This resultant weight reduction reduces cartridge 10 feeding and ejection effort in the straight blowback operated firearms and improves overall functional performance of cartridge 10.

To ensure consistent cartridge 10 feeding performance from firearms magazine to barrel chambers, the introduction of the velocity reduction structure 30 usually requires the introduction of sabot external feature 59 which is preferably slightly angled or curved and starting preferably at a point substantially equal to external diameter of cylindrical surface 34. The distance between the forward end 52 of sabot 50 and the beginning of sabot external feature 59 is defined by dimension $X_8$. The distance between the beginning of sabot external feature 59 and the beginning of canted surface 32 is represented by dimension $X_7$. In a preferred embodiment for use in handgun-caliber ammunition, dimension $X_8$ is preferably equal to or greater than dimension $X_7$ to ensure consistent cartridge 10 feeding performance from the firearm's magazine to the barrel's chamber, The preferable assembly contact between sabot external surface 55 with case front surface 27 enables to set a precise and robust cartridge 10 headspace dimension $X_5$ ensuring proper operation of straight blowback operated firearms.

Figure 2:
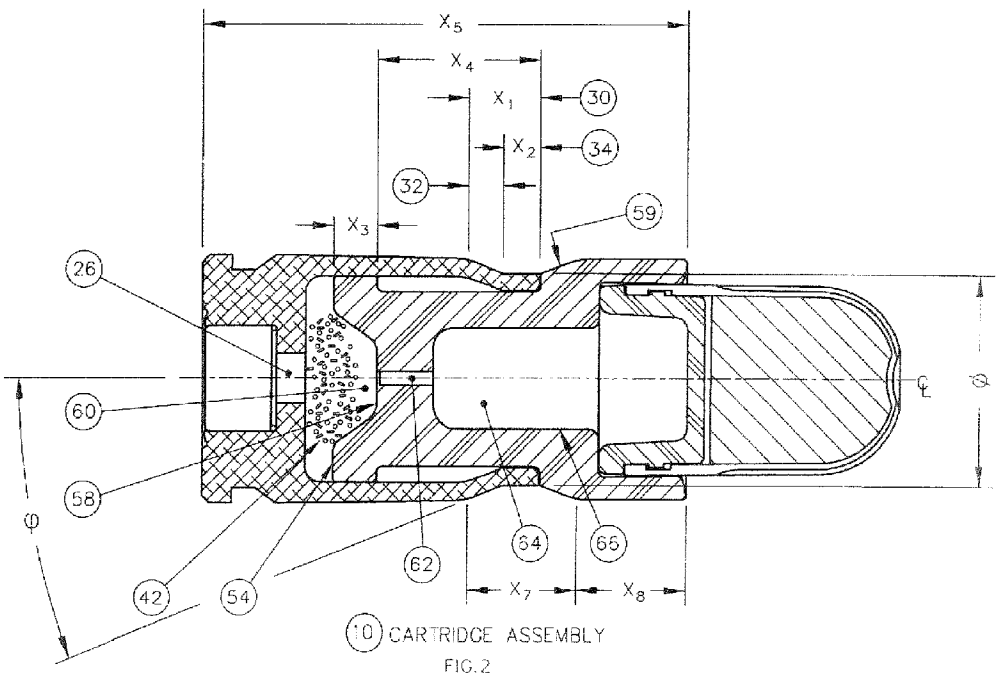
FIG. 2 is a cutaway side view of an assembled reduced energy training cartridge according to one embodiment of the present invention.
Figure 3:
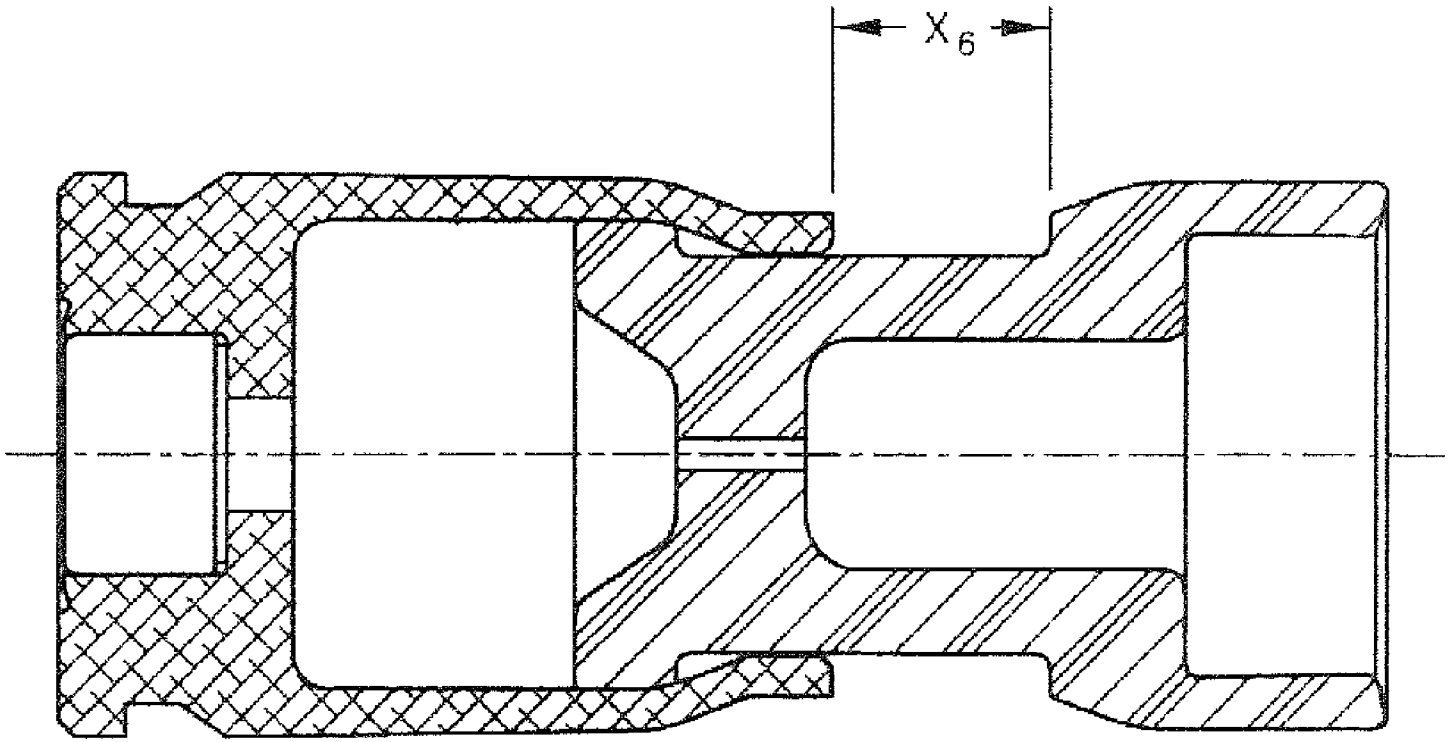
FIG. 3 is a cutaway side view showing a reduced energy training cartridge according to one embodiment of the present invention after it has been fired.

As shown in FIG. 1 and FIG. 2, sabot 50 has a forward end 52 and a rearward end 54. Sabot 50 further contains a sealing and braking structure 56. The outer diameter of sealing and braking structure 56 is preferably substantially equal to the inside diameter of outer wall 24 such that sealing and braking structure 56 fits tightly within case 20 but permits case 20 to slide relative to sabot 50 upon the application of sufficient level of gas pressure. Sealing and braking structure 56 has a length $X_3$ which can be varied depending on the material selected for sabot 50. Upon percussion of primer 40, cartridge gas pressure expansion forces case 20 to slide rapidly relative to sabot 50 up to the point at which velocity reduction structure 30 interacts with sealing and braking structure 56. The length $X_3$ of sealing and braking structure 56 must be sufficient to both adequately seal off gas pressure during and once case 20 completes its sliding movement and to provide sabot 50 with enough structural strength to survive the impact load experienced by sabot 50 when cartridge 10 is fired. Thus, as it is a purpose of this invention to provide a sabot 50 made from non-metallic materials, careful selection of material and length $X_3$ is necessary, desired $X_3$ length increases must also be compromised with velocity reduction surface 30 design and available sabot 50 distance $X_4$ etc. In one embodiment, when sabot 50 is made from competitively priced engineering polymer, a length $X_3$ of between 0.060 and 0.090 inches is generally acceptable with 0.075 inches being most preferred. In a preferred embodiment typically involving handgun-caliber training ammunition, sealing and braking structure 56 is an integrated component of sabot 50 which is located adjacent to the rearward end 54 of sabot 50 given the relatively short dimensions inherent in such ammunition.

Figure 4:
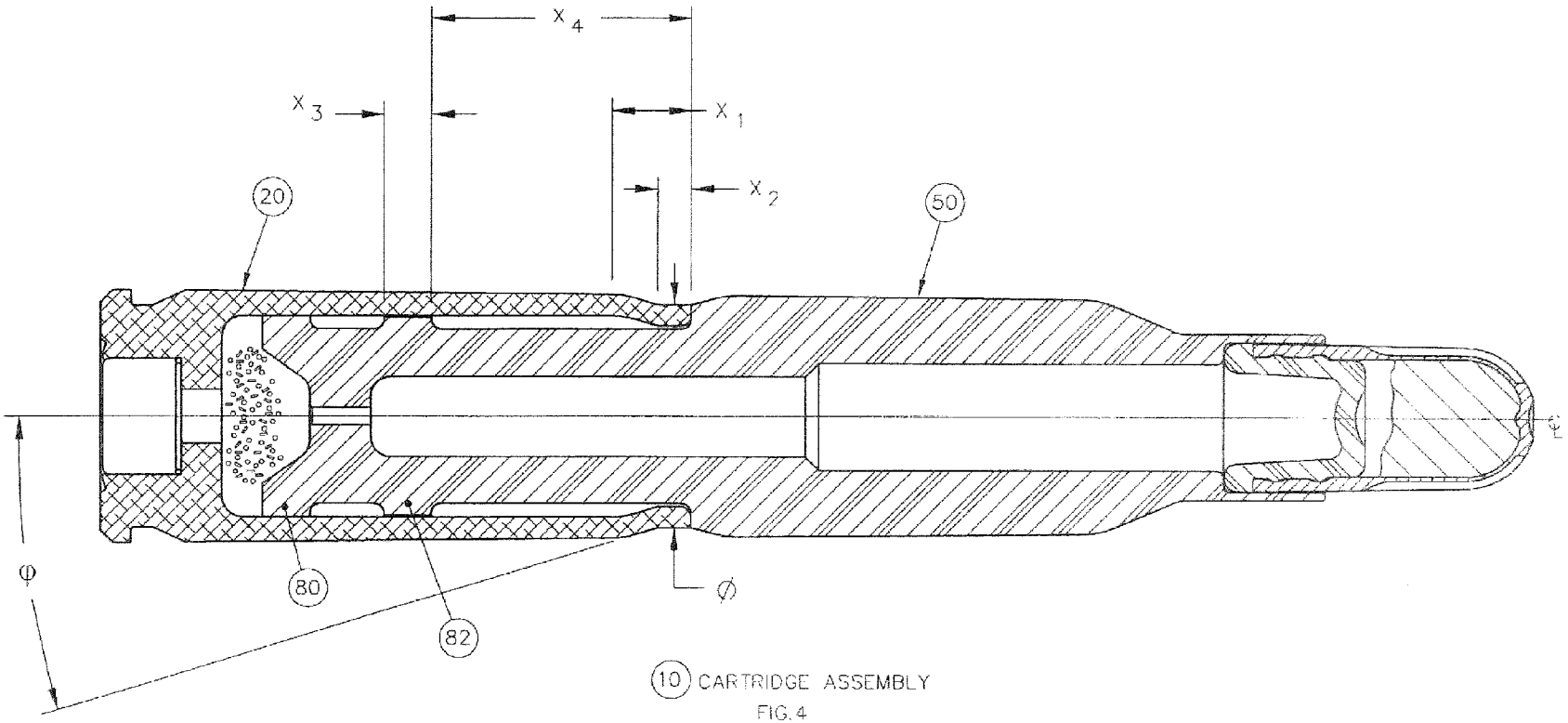
FIG. 4 is a cutaway side view of an assembled, long-rifle caliber reduced energy training cartridge according to one embodiment of the present invention.

In another embodiment, typically involving long-rifle caliber ammunition, the use of a non-integrated sealing and braking structure is possible. For example, as shown in FIG. 4, sealing portion 80 and braking portion 82 can be located at different locations anywhere along the axis of sabot 50 as the overall length of cartridge 10 is significantly greater in those applications. In such applications, the combination of sealing portion 80 and braking portion 82 serves the same functional role as sealing and braking structure 56 does in handgun-caliber applications. The non-integrated design contemplated in long-rifle caliber ammunition can also be employed in handgun-caliber ammunition and is specifically within the scope of the present invention.

Rearward end 54 can further contain a concave surface 58. Upon insertion of sabot 50 into case 20, a combustion chamber 60 is formed. The perimeter of combustion chamber 60 is encompassed by concave surface 58 and the inside surface of the rear portion 21 of case 20. In some embodiments of the present invention a propellant charge 42 is placed within the volume of combustion chamber 60 to provide additional explosive gas pressure to the operation of cartridge 10, however the present invention can operate exclusively with primer 40 provided that primer 40 has sufficient explosive gas pressure.

Rearward end 54 further contains at least one gas transfer channel 62 which allows a controlled amount of gas pressure generated from the firing of primer 40 (and, if used, propellant 42) to pass from combustion chamber 60 to outer chamber 64. In another embodiment for creating "silent blanks," sabot 50 does not contain gas transfer channel 62. Thus, all of the energy from primer 40 and, if used, propellant 42 is utilized to cycle the blowback operated firearm. The diameter of gas transfer channel 62 is typically less than the diameter of combustion chamber 60 in order to allow only a portion of the gas pressure to interact with projectile 70 and thereby exercise precise control over projectile velocity. Given the restrictive nature of gas transfer channel 62, the majority of the cartridge gas pressure acts to slide case 20 relative to the sabot 50, thereby cycling the straight blowback operated firearm. The gas transfer channel 62 may include a thin membrane 51 in order to contain propellant powder or seal off combustion chamber 60 before firing cartridge 10. In embodiments utilizing only a primer 40 for explosive energy, thin membrane 51 may be omitted.

Sabot 50 further comprises an outer chamber 64 whose outer perimeter is delineated by the inner wall 66 of sabot 50 and the rear wall 72 of projectile 70. The diameter of outer chamber 64 can be constant or variable and will be determined based on the material chosen for sabot 50. Outer chamber 64 may also contain reinforcement structures depending on the material chosen. When assembled, outer chamber 64 preferably has a greater volume than inner chamber 60 in order to evenly distribute the gas pressure onto projectile 70 upon firing.

Sabot 50 preferably has a stepped portion 57. Stepped portion 57 preferably has a diameter less than that of the sealing and braking structure 56 and slightly less than that of the inside diameter of cylindrical surface 34. The length $X_4$ of stepped portion 57 and length $X_6$ of fired cartridge 15 are determined based on the distance necessary for case 20 to travel relative to sabot 50 in order to successfully cycle straight blowback operated firearms. In a preferred embodiment using handgun reduced energy training ammunition of caliber 9 mm, 0.357, 0.40, etc., length $X_4$ is approximately 0.25 inches and length $X_6$ approximately 0.17 inches.

Figure 5:
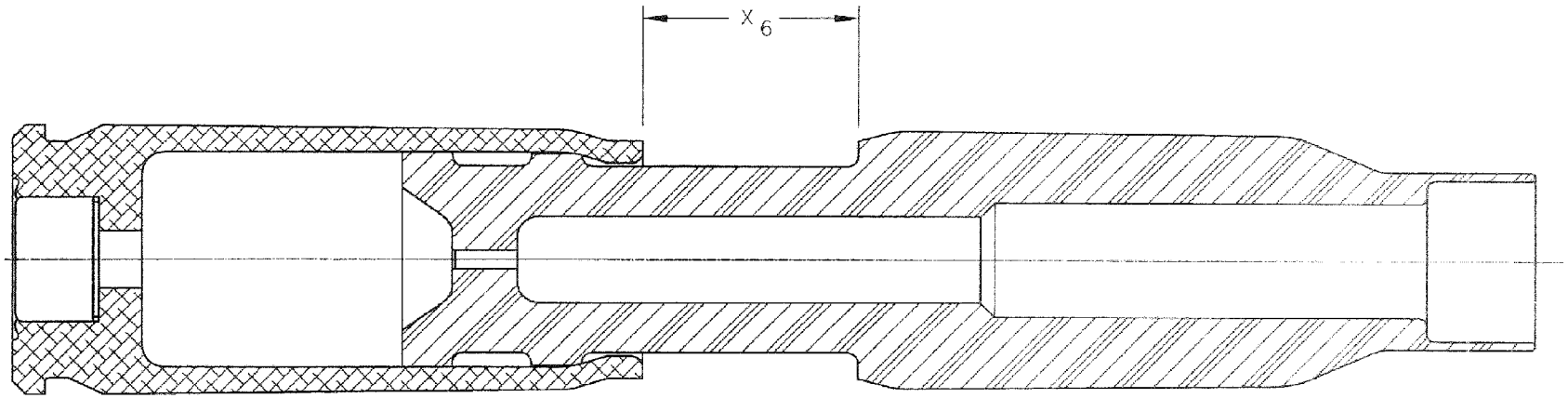
FIG. 5 is a cutaway side view showing a long-rifle caliber reduced energy training cartridge according to one embodiment of the present invention after it has been fired.

In a preferred embodiment using long-rifle reduced energy training ammunition of caliber 5.56 mm, etc., as shown in FIG. 4, the increased case length design range enables $X_4$ to be set starting approximately at 0.25 inches and up to approximately 0.50 inches or more, resulting length $X_6$ may vary approximately from 0.17 inches and up to approximately 0.45 inches or more, as shown on FIG. 5. It is understood that in long-rifle applications, length $X_4$ is associated with the sabot breaking portion 82 and that the sealing portion 80 may be disassociated from the sabot braking portion 82 by placing the sabot breaking portion 82 forward of the sabot sealing portion 80. In long-rifle applications, case 20 typically has canting angle $\phi$ of between 5° and 45°, with a range of between 10° and 25° being more preferred.

Referring back to FIG. 1 which illustrates a preferred embodiment of the present invention in a handgun-caliber application, forward end 52 of sabot 50 preferably has an outer diameter slightly less than the portion of case 20 having the largest outer diameter. Forward end 52 has a recess 53 into which projectile 70 is seated. Projectile 70 typically contains some kind of marking substance in order to facilitate training exercises employing cartridge 10 in "live fire" scenarios. Alternatively, projectile 70 can be a short-range target shooting projectile. Further, in applications desiring a "blank" round, both recess 53 and projectile 70 can be omitted.

In operation, cartridge 10 is normally fed from the magazine to the barrel chamber of a straight blowback operated firearm. When cartridge 10 is fully chambered by the firearm bolt or slide, percussion of primer 40 generates gas pressure which travels through gas passage port 26, ignites propellant 42 (if used) and partially transfers the combustion gases through gas transfer channel 62 before the gases act against projectile 70, propelling projectile 70 out of the barrel at a controlled velocity. The remaining gas pressure contained in combustion chamber 60 rapidly expands to slide case 20 relative to sabot 50 which cycles the straight blowback operated firearm. The cartridge 10 of the present invention can function in straight blowback operated firearms in single, burst and automatic modes.

Now that the invention has been described,

What is claimed is:

1. A reduced energy training cartridge for use in a straight blowback operated firearm, said cartridge comprising: a cartridge case being defined by a rear portion with an external groove, a front portion, and an intermediate cylindrical wall; a velocity reduction structure defined by the front portion of the cartridge case, said velocity reduction structure comprising a frustoconical wall having inner and outer canted surfaces and originating from the intermediate cylindrical wall of the of the cartridge case, said velocity reduction structure further comprising a cylindrical wall, having inner and outer surfaces, originating from the frustoconical wall and defining a front-most surface of the cartridge case, said cylindrical wall of the velocity reduction structure having a smaller outer diameter than said intermediate cylindrical wall;

a sabot slidably engaged within said cartridge case, said sabot having a rear portion, with an outside diameter substantially equal to the inside diameter of said intermediate cylindrical wall of said cartridge case, and a sealing and braking structure, said sealing and braking structure of said sabot interacting with said inner canted surface of said velocity reduction structure of said cartridge case, with the proviso that said inner surface of the cylindrical wall of said velocity reduction structure does not contact said sealing and braking structure of said sabot; and a primer disposed in said rear portion of said cartridge case;

wherein, upon percussion of said primer, said cartridge case slides relative to said sabot until such point when said inner canted surface of said velocity reduction structure of said cartridge case interacts with said sealing and braking structure of said sabot, thereby stopping further movement of said cartridge case relative to said sabot through said interaction of said sealing and braking structure with said inner canted surface of said velocity reduction structure of said cartridge case and wherein said sealing and braking structure does not contact the inner surface of the cylindrical wall of said velocity reduction structure.

2. The training cartridge of claim 1 wherein said cartridge case is made from a metal or metal alloy.

3. The training cartridge of claim 2 wherein said sabot is made from a non-metallic material.

4. The training cartridge of claim 3 wherein said sabot is made from a polymer.

5. The training cartridge of claim 4 wherein said front portion of said sabot further contains a forward cavity area disposed about the axis of said sabot.

6. The training cartridge of claim 5 wherein said sabot further contains a rear recessed area.

7. The training cartridge of claim 6 wherein said sabot further contains at least one gas passage port connecting said rear recessed area and said forward cavity area.

8. The training cartridge of claim 7 wherein said forward cavity area is adapted to receive a projectile.

9. The training cartridge of claim 8 wherein said cartridge case is sized to operate straight blowback operated firearms.

10. The training cartridge of claim 1 wherein said sabot further comprises a sabot external feature, said sabot external feature starting at a point substantially equal to said cylindrical wall of said velocity reduction structure.

11. The training cartridge of claim 10 wherein said inner canted surface has an angle of slope between 5 degrees and 45 degrees relative to said center line of said cartridge case.

12. The training cartridge of claim 11 wherein said sabot further comprises a sabot external angular or curved feature to aid in the feeding of training cartridges from a firearm magazine to barrel chamber.

13. A reduced energy training cartridge for use in a long-rifle caliber, straight blowback operated firearm, said cartridge comprising: a cartridge case being defined by a rear portion with an external groove, a front portion, and an intermediate cylindrical wall; a velocity reduction structure defined by the front portion of the cartridge case, said velocity reduction structure comprising a frustoconical wall having inner and outer canted surfaces and originating from the intermediate cylindrical wall of the of the cartridge case, said velocity reduction structure further comprising a cylindrical wall, having inner and outer surfaces, originating from the frustoconical wall and defining a front-most surface of the cartridge case, said cylindrical wall of the velocity reduction structure having a smaller outer diameter than said intermediate cylindrical wall; a sabot slidably engaged within said cartridge case, said sabot having a rear portion with an outside diameter substantially equal to the inside diameter of said intermediate cylindrical wall of said cartridge case, a sealing portion, and braking portion, said braking portion of said sabot interacting with said inner canted surface of said velocity reduction structure of said cartridge case, with the proviso that said inner surface of the cylindrical wall of said velocity reduction structure does not contact said braking portion of said sabot; and a primer disposed in said rear portion of said cartridge case; wherein, upon percussion of said primer, said cartridge case slides relative to said sabot until such point when said inner canted surface of said velocity reduction structure of said cartridge case interacts with said braking portion of said sabot, thereby stopping further movement of said cartridge case relative to said sabot through said interaction of said braking portion with said inner canted surface of said velocity reduction structure of said cartridge case and wherein said braking portion does not contact the inner surface of the cylindrical wall of said velocity reduction structure.

14. The training cartridge of claim 13 wherein said cartridge case is made from a metal or metal alloy.

15. The training cartridge of claim 14 wherein said sabot is made from a non-metallic material.

16. The training cartridge of claim 15 wherein said sabot is made from a polymer.

17. The training cartridge of claim 16 wherein said front portion of said sabot further contains a forward cavity area disposed about the axis of said sabot.

18. The training cartridge of claim 17 wherein said sabot further contains a rear recessed area.

19. The training cartridge of claim 18 wherein said sabot further contains at least one gas passage port connecting said rear recessed area and said forward cavity area.

20. The training cartridge of claim 19 wherein said forward cavity area is adapted to receive a projectile.

21. The training cartridge of claim 20 wherein said cartridge case is sized to operate straight blowback operated firearms.

22. The training cartridge of claim 13 wherein said sabot further comprises a sabot external feature, said sabot external feature starting at a point substantially equal to said cylindrical wall of said velocity reduction structure.

23. The training cartridge of claim 22 wherein said inner canted surface has an angle of slope between 5 degrees and 45 degrees relative to said center line of said cartridge case.

24. The training cartridge of claim 23 wherein said sabot further comprises a sabot external angular or curved feature to aid in the feeding of training cartridges from a firearm magazine to barrel chamber.

* * * * *